US006771228B1

(12) United States Patent
Sergi

(10) Patent No.: US 6,771,228 B1
(45) Date of Patent: Aug. 3, 2004

(54) INSULATOR TO ATTACH AN ANTENNA ELEMENT TO AN ANTENNA BOOM

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 8 days.

(21) Appl. No.: 10/347,548

(22) Filed: Jan. 21, 2003

(51) Int. Cl.[7] ..... H01Q 9/34; H01Q 1/12
(52) U.S. Cl. ..... 343/874; 343/878
(58) Field of Search ..... 343/797, 812, 343/815, 878, 888, 892, 874, 880, 890, 891

(56) References Cited

U.S. PATENT DOCUMENTS 4,468,674 A * 8/1984 Blonder ..... 343/815
5,886,672 A * 3/1999 Brune et al. ..... 343/792.5
6,677,912 B1 * 1/2004 McLean ..... 343/792.5
6,677,914 B2 * 1/2004 Mertel ..... 343/815

OTHER PUBLICATIONS

Two photographs of a prior art antenna insulator (undated).

* cited by examiner

*Primary Examiner*—James Clinger
*Assistant Examiner*—Minh Dieu A
(74) *Attorney, Agent, or Firm*—Renner, Kenner, Greive, Bobak, Taylor & Weber

(57) ABSTRACT

An antenna (10) includes a boom (12) which through insulator blocks (15) carries a plurality of elements (13) consisting of element halves (13A, 13B) which extend in opposite directions from the boom (12). The insulator block (15) includes compartments (18) to receive the element halves (13A, 13B) and a pedestal (38) formed below each compartment (18) provides strength to that area of the block (15). The block (15) has opposed sidewalls (22) with surfaces (24) to receive the boom (12). The bands (33) of a clamp hold the boom (12) and are received in the space between the pedestals (29) and the sidewalls (22). A cross-shaped member (27) is also located between the sidewalls (22) to strengthen the block (15) while at the same time reducing the weight thereof.

14 Claims, 4 Drawing Sheets

INSULATOR TO ATTACH AN ANTENNA ELEMENT TO AN ANTENNA BOOM

TECHNICAL FIELD

This invention relates to insulators for antennas. More particularly, the insulators of this invention are particularly suited to attach the elements to the boom of antennas such as a log-periodic dipole or Yagi style antenna.

BACKGROUND ART

Antennas, for example, of the log-periodic dipole or Yagi type are designed to assist in the transmission or reception of radio wave signals. These antennas include a plurality of spaced elements which are carried by and extend outwardly from a boom. Feeder or transmission wires are connected to at least some of the elements to carry the signals to be transmitted or the signals received by the elements.

One problem that exists regarding the current design and configuration of such antennas relates to the insulators which must be provided at the junction of each element and the boom. These insulators, usually made of a plastic material, not only act to isolate the elements from the boom, but also they provide the means by which the elements and the boom are connected. Since the boom and the elements can be quite heavy, the insulators must be quite sturdy. However, the configuration, material and design of currently known insulators is such that cracking and ultimate breakage often occurs, particularly in adverse weather conditions such as high winds. When such breakage occurs, the insulating effect of these members can be destroyed to the detriment of efficient radio wave transmission and reception. Thus, the need exists for an insulator which is of a configuration which minimizes the chances of breakage.

DISCLOSURE OF THE INVENTION

It is thus an object of the present invention to provide an antenna with unique insulators which attach the antenna elements to the antenna boom.

It is another object of the present invention to provide insulators for an antenna, as above, which are designed to minimize breakage thereof under the normal stresses encountered.

These and other objects of the present invention, as well as the advantages thereof over existing prior art forms, which will become apparent from the description to follow, are accomplished by the improvements hereinafter described and claimed.

In general, an antenna made in accordance with one aspect of the present invention includes an insulator assembly having opposed sidewalls which have a surface to receive the boom. A cross-shaped member is located between the sidewalls to strengthen the insulator while at the same time reducing the weight thereof.

In accordance with another aspect of the insulator assembly of the present invention, a compartment is included to carry each portion of an element. A pedestal is formed beneath each compartment for strength. In addition, each pedestal has at least one recess therein.

In another aspect of the present invention, the insulator assembly includes clamps, each having a band to hold the boom. The insulator assembly also includes opposed sidewalls having a surface to receive the boom. Opposed pedestals are positioned between and spaced from the sidewalls a distance to receive the bands. Each pedestal receives a fastener to engage the bands and a fastener to hold the element.

A preferred exemplary antenna insulator incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
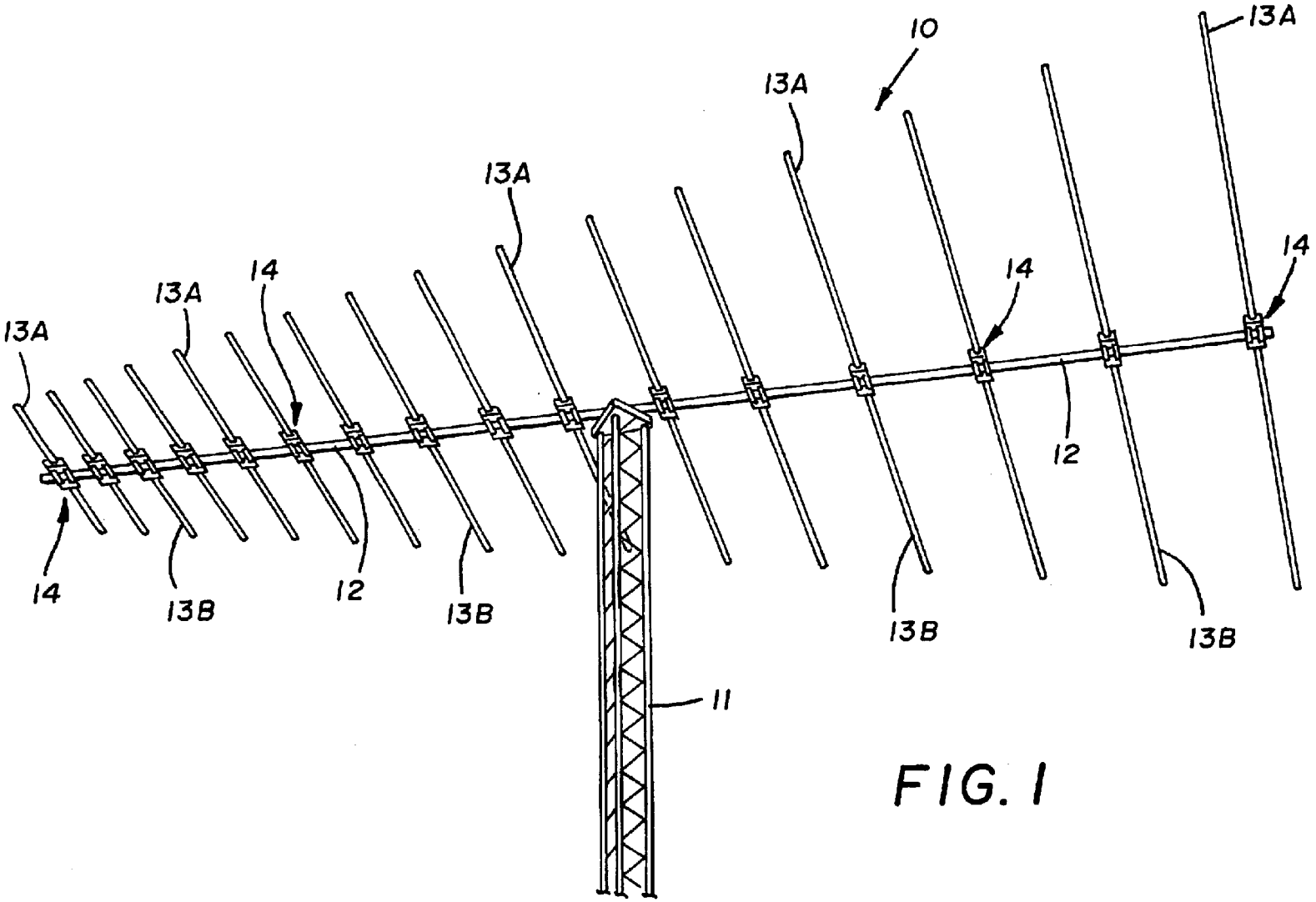
FIG. 1 is a somewhat schematic depiction of the overall configuration of an antenna made in accordance with the present invention.

A log-periodic dipole or Yagi style antenna is somewhat schematically shown in FIG. 1 and indicated generally by the numeral 10. Antenna 10 normally includes a tower 11 which carries a horizontally and longitudinally extending boom 12. A plurality of longitudinally spaced elements 13 consist of half elements 13A and 13B which extend laterally from boom 12 in opposite directions from boom 12. As shown, the elements 13 are of varying length and number dependent on the design parameters of antenna 10. The antenna 10 of FIG. 1 is shown as having sixteen elements 13 with the elements 13 increasing in length from the left to the right as viewed in FIG. 1.

Figure 2:
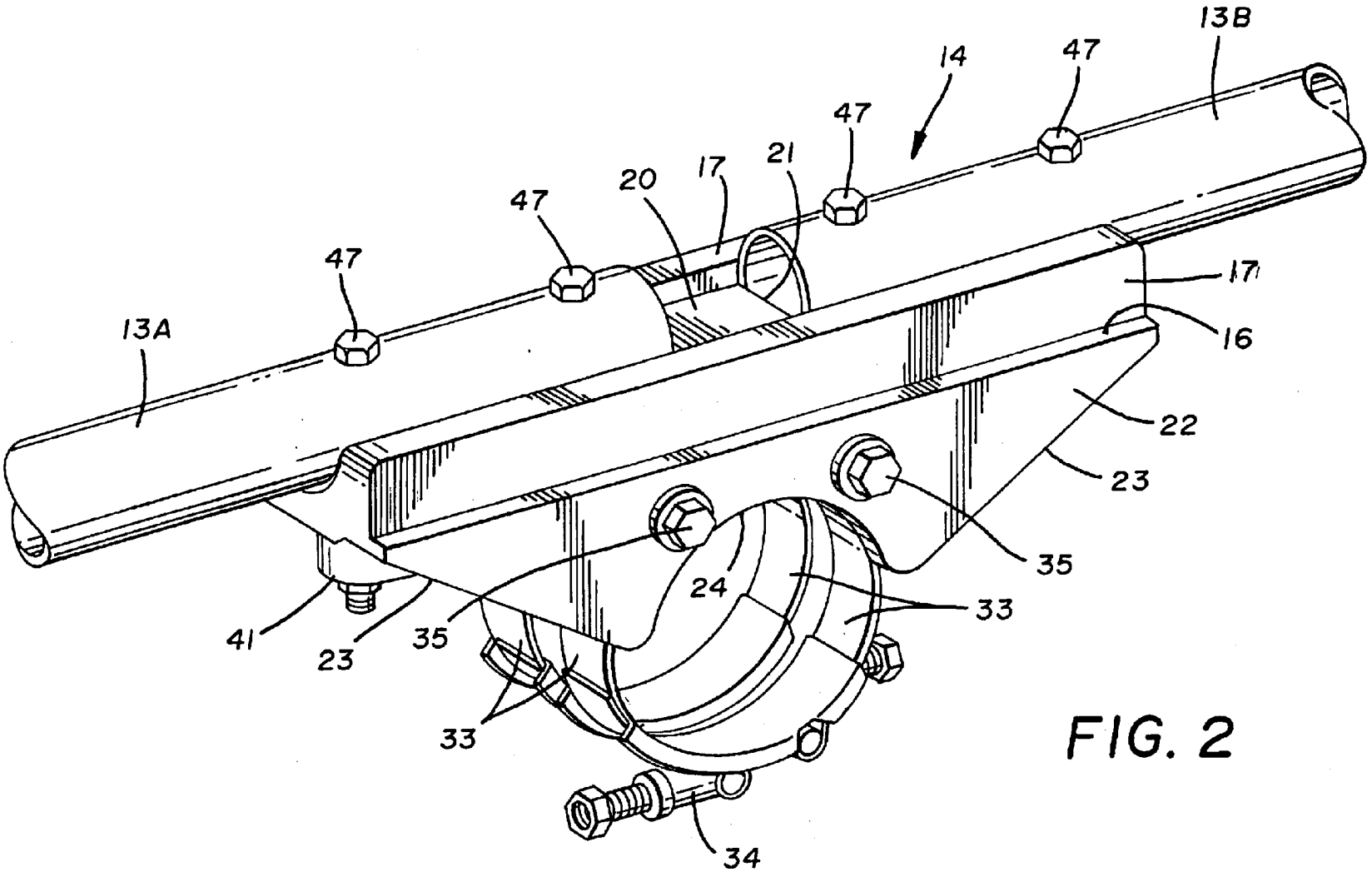
FIG. 2 is a perspective view of an insulator assembly made in accordance with the present invention showing the antenna elements attached thereto.

Elements 13 must be isolated from boom 12. As such, an insulator assembly generally indicated by the numeral 14, is provided at each junction of elements 13 with boom 12. Insulator assembly 14 is best shown in FIG. 2, and its primary component, an insulator block, generally indicated by the numeral 15, is best shown in FIGS. 3–6. Insulator block 15 is preferably made of a strong, rigid, ultra-violet resistant plastic material, such as rigid thermoplastic polyurethane or the like, and is specially designed and configured to avoid the problems of the prior art while connecting elements 13 to boom 12.

In this regard, each insulator block 15 includes a generally centrally located shelf 16 having opposed element shoulders 17 extending upwardly therefrom. Shoulders 17 are continuous items which generally extend the entire length of block 15 and provide structural strength to block 15 thereby reducing the tendency of the formation of cracks or deterring the spreading of a crack formed elsewhere in block 15. Element receiving compartments 18 are formed between shoulders 17 and have arcuate bottom surfaces 19 which are designed to generally match the circumference of a range of sizes of elements 13 as shown in FIG. 2. Compartments 18 are axially aligned and are separated by a divider block 20 which, with a generously radiused transition 21, extends upwardly between shoulders 17 to define compartments 18. The configuration of divider block 20 will likewise reduce the tendency of block 15 to crack under stress.

Figure 3:
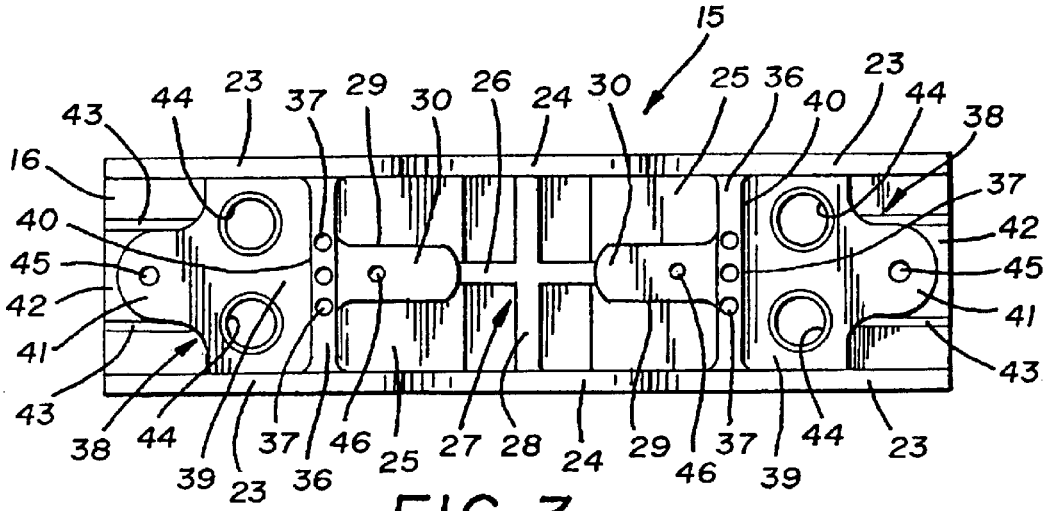
FIG. 3 is a bottom plan view of the insulator block of the insulator assembly made in accordance with the present invention.
Figure 4:
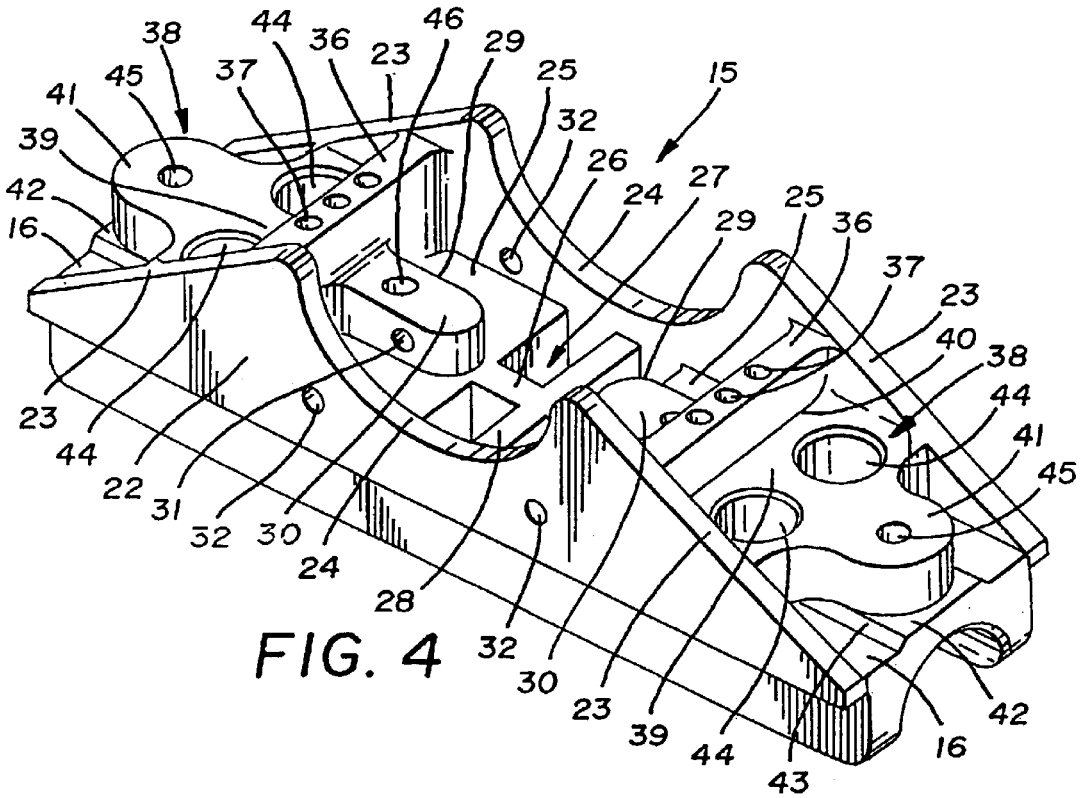
FIG. 4 is a bottom perspective view of the insulator block of FIG. 3.

Opposed sidewalls 22 extend downwardly from shelf 16 and are provided with sloped surfaces 23 which are interconnected by a generally semicircular surface 24. As best shown in FIGS. 3 and 4, opposed platforms 25 are formed between sidewalls 22 at the area of sloped surfaces 23. Platforms 25 are spaced from each other by one branch 26 of a cross-shaped member, generally indicated by the numeral 27, which has a branch 28 transverse to branch 26 and extending between sidewalls 22 at the area of semicircular surface 24. This cross-shaped member 27 not only serves to lighten block 15 by somewhat hollowing out divider block 20, but also at the same time, it provides significant strength to block 15 in both directions.

A pedestal 29 extends downwardly from each platform 25 and has an outer land surface 30. Pedestals 29 not only provide additional crack resistant strength to block 15, but also are provided with an aperture 31 extending horizontally therethrough. Apertures 31 are aligned with apertures 32 formed in sidewalls 22.

As shown in FIG. 2, insulator assembly 14 includes two conventional band clamps having a body portion in the form of a band 33, and a clamping portion 34. The bands 33 of the band clamps are adapted to engage boom 12 which extends through the space defined by a portion of bands 33 and semicircular surfaces 24 of block sidewalls 22. To attach insulator block 15 to boom 12, a portion of the bands 33 is placed on the area of platforms 24 between pedestal 29 and sidewalls 22. It should be noted that the distance between pedestal 29 and sidewalls 22 should be as great as possible to permit the use of clamps having as wide a band 33 as possible. It should also be evident that with bands 33 tightly, laterally confined between pedestal 29 and sidewalls 22, alignment of block 15 relative to boom 12 is maintained. That is, this configuration prevents block 15 from twisting on boom 12 during times of high winds or other adverse weather conditions. With the bands 33 being positioned as just described, bolts 35 are extended through apertures 31 and 32 and are tightened to hold bands 33 against platform 25. Boom 12 is then positioned within bands 33 and received against surfaces 24, and the clamping portions 34 are tightened to hold boom 12 in place. Boom 12 will also come into contact with, and thus be somewhat supported by, the inner ends of pedestals 29. Pedestals 29 thus serve to provide more strength to hold boom 12 to block 15 than would be provided if bolts 35 merely went through apertures 32.

Block 15 also includes support walls 36 which extend between sidewalls 22 near the junction of sloped surfaces 23 and semicircular surfaces 24. Support walls 36 tend to tie sidewalls 22 together to further strengthen block 15, but can be provided with a plurality of material saving apertures 37 without detracting from that strength function. Moreover, walls 36 generally tie platforms 25 and pedestals 29 to additional pedestals, generally indicated by the numeral 38, which are positioned on the opposite side of walls 36 from pedestals 29.

Each pedestal 38 includes a base portion 39 which extends downwardly from shelf 16 and outwardly from support wall 36 between sidewalls 22. The junctions 40 between base portions 39 and support walls 36 may be generously radiused to provide resistance against cracking or the spreading of cracking that may have been initiated elsewhere on block 15. Each pedestal 38 also includes a radiused portion 41 integrally formed with base portion 39. The radiused portions 41 extend downwardly from a ledge 42 formed on shelf 16. The radiused portion 41 along with radiused areas 43 between ledge 42 and shelf 16 also prevent crack generation or promulgation.

Because the area of pedestal 38 formed beneath compartments 18, for strength purposes, constitutes a large volume of plastic material, it would tend to cool slowly and unevenly during the molding process. Such could cause swelling of the part to create internal voids which would reduce its strength. As such, a plurality of recessed areas 44 can be provided in base portion 39. These areas 44 promote cooling of block 15 after molding, but they do not detract from the additional strength afforded by pedestals 38.

Figure 5:
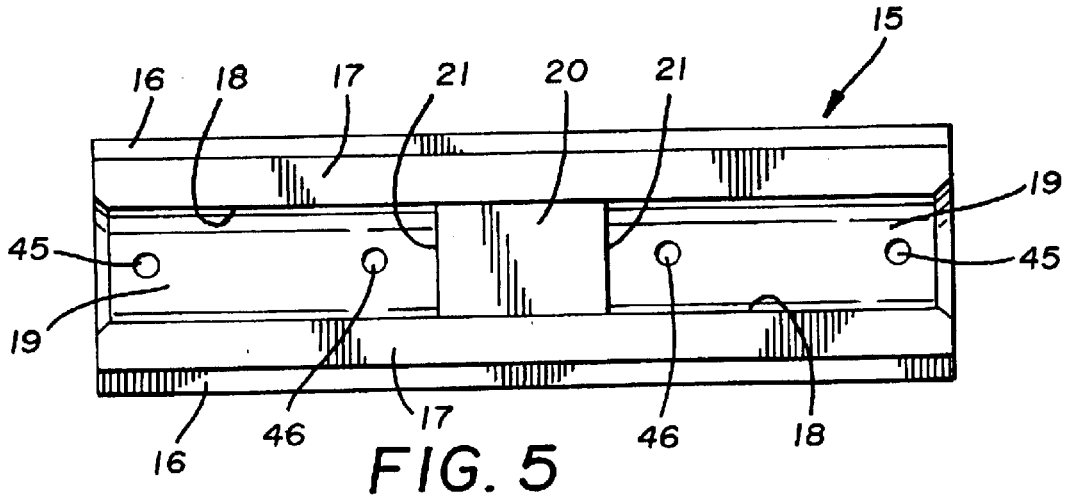
FIG. 5 is a top plan view of the insulator block of FIG. 3.
Figure 6:
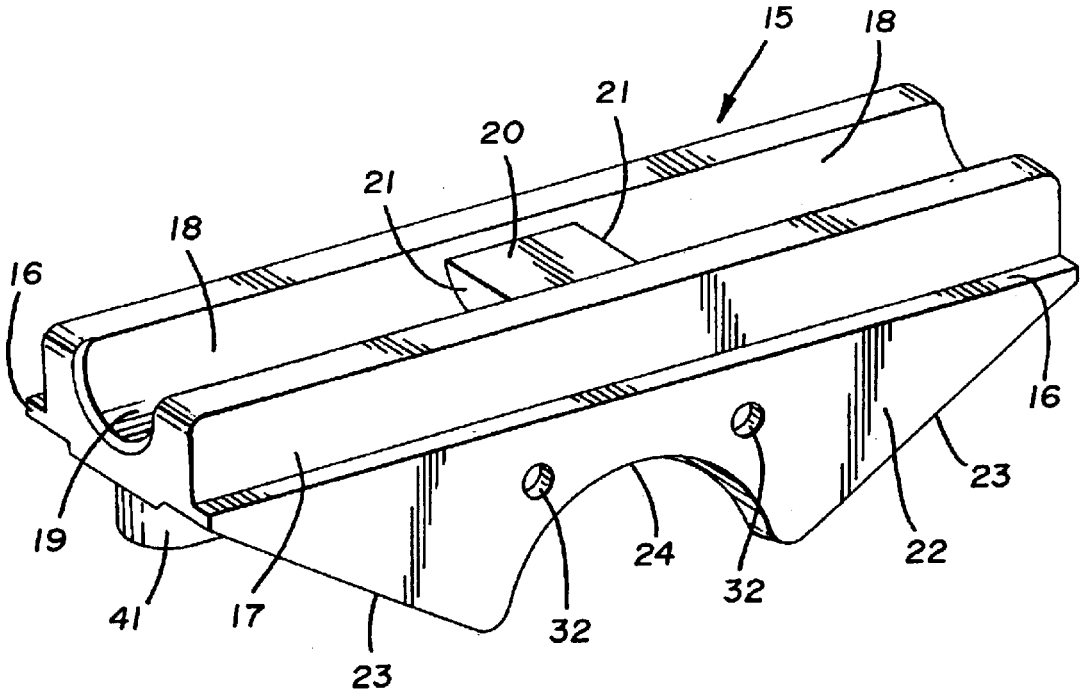
FIG. 6 is a top perspective view of the insulator block of FIG. 3.

To attach element portions or halves 13A and 13B to insulator block 15, portions 41 of each pedestal 38 are provided with an aperture 45 which extends vertically through ledge 42, shelf 16 and surfaces 19 of element receiving compartments 18, as shown in FIG. 5. Similarly, each pedestal 29 is provided with an aperture 46 extending vertically therethrough, and through platforms 25 and surfaces 19 of element receiving compartments 18. The inner ends of element halves 13A and 13B are provided with two sets of diametrically opposed apertures, and when the ends of halves 13A and 13B are positioned in compartments 18, as shown in FIG. 2, these apertures may be aligned with apertures 45 and 46, and fasteners 47 extended therethrough to attach element halves 13A and 13B to block 15. The raised pedestals 29 and 38 through which fasteners 47 pass advantageously allows for the use of a longer fastener which will more readily accommodate the elongation forces generated by temperature changes and the like. Moreover, the raised land surfaces 30, for example, make access to fasteners 47 easier than if the head of the fasteners 47 were more recessed within block 15.

In view of the foregoing, it should be evident that an insulator for an antenna constructed in accordance with the present invention as described herein accomplishes the objects of the invention and otherwise substantially improves the art.

What is claimed is:

1. An insulator assembly adapted to attach an element of an antenna to the boom of an antenna comprising opposed sidewalls having a surface to receive said boom, and a cross-shaped member located between said sidewalls to strengthen the assembly while at the same time reducing the weight of the assembly.

2. The insulator assembly of claim 1 wherein the element includes a first portion and a second portion, said assembly further comprising compartments to receive the element portions.

3. The insulator assembly of claim 2 wherein said compartments are divided by a block, said cross-shaped member serving to hollow out said block.

4. The insulator assembly of claim 2 further comprising opposed shoulders extending generally the entire length of said compartments.

5. The insulator assembly of claim 2 further comprising a pedestal formed beneath each compartment to strengthen that area of the insulator assembly, said pedestal having recessed areas formed therein to provide cooling of the insulator assembly after molding.

6. The insulator assembly of claim 1 further comprising clamps each having a band to hold the boom, opposed pedestals between said sidewalls and adjacent to said cross-shaped member, said pedestals being spaced from said sidewalls so that said bands may be received in said spaces.

7. An insulator assembly adapted to attach portions of an element of an antenna to the boom of an antenna comprising a compartment to carry each said element portion, and a pedestal formed beneath each said compartment for strength, each said pedestal having at least one recess therein.

8. The insulator assembly of claim 7, said pedestals providing a thick surface to receive fasteners to hold said element portions in said compartments.

9. The insulator assembly of claim 7 further comprising clamps each having a band to hold the boom, and opposed additional pedestals beneath said compartments, said pedestals being spaced from said sidewalls so that said bands may be received in said spaces.

10. The insulator assembly of claim 9 further comprising a support wall between each said pedestal and each said additional pedestal, said support wall having apertures therein.

11. The insulator assembly of claim 9 further comprising fasteners received through said opposed additional pedestals to hold said bands in said spaces, and second fasteners received through said opposed additional pedestals to hold said element portions in said compartments.

12. An insulator assembly adapted to attach an element of an antenna to the boom of an antenna comprising clamps each having a band to hold the boom, opposed sidewalls having a surface to receive the boom, opposed pedestals between said sidewalls and spaced a distance therefrom to receive said bands, each said pedestal receiving a fastener to engage said bands and a fastener to engage the element.

13. The insulator assembly of claim 12 wherein said distance approximates the width of each said band.

14. An insulator assembly adapted to attach an element of an antenna to the boom of an antenna comprising a block; and clamps adapted to engage the boom; said block having opposed sidewalls having a surface adapted to receive the boom; said clamps each having a band adapted to hold the boom; said block including opposed pedestals between said sidewalls and spaced a distance therefrom adapted to receive the bands, each said pedestal receiving a fastener to engage said bands and a fastener adapted to engage the element portions, a cross-shaped member located between said sidewalls to strengthen said block while at the same time reducing the weight of said block, a compartment adapted to carry each said element portion, and an additional pedestal formed beneath each said compartment for strength, each said pedestal having at least one recess therein.

* * * * *